US012061069B1

(12) United States Patent
Barr et al.

(10) Patent No.: US 12,061,069 B1
(45) Date of Patent: Aug. 13, 2024

(54) MULTI-LAYER WEARABLE BODY ARMOR

(71) Applicant: Honeywell Federal Manufacturing & Technologies, LLC, Kansas City, MO (US)

(72) Inventors: Christian G. Barr, Kansas City, MO (US); Ben Brown, Kansas City, MO (US); John Porter, Kansas City, MO (US); Gregory John Vernon, Kansas City, MO (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 283 days.

(21) Appl. No.: 17/734,589

(22) Filed: May 2, 2022

(51) Int. Cl.
*F41H 5/04* (2006.01)

(52) U.S. Cl.
CPC ..... *F41H 5/0457* (2013.01)

(58) Field of Classification Search
CPC ..... F41H 5/0457
USPC ..... 89/36.02
See application file for complete search history.

(56) References Cited

U.S. PATENT DOCUMENTS 10,591,257 B1 * 3/2020 Barr ..... B22F 10/28
11,015,904 B1 * 5/2021 Barr ..... F41H 5/08
11,781,839 B1 * 10/2023 Barr ..... F41H 5/08 89/36.02
2016/0102949 A1 * 4/2016 Smith ..... F41H 5/0492 89/36.02
2021/0396496 A1 * 12/2021 Barr ..... F41H 5/04

* cited by examiner

*Primary Examiner* — Samir Abdosh
(74) *Attorney, Agent, or Firm* — Hovey Williams LLP

(57) ABSTRACT

A multi-layer armor plate comprises a strike plate, a structural mesh layer, an outer skin, a compliant mesh layer, and an inner skin layer. The strike plate has an outer surface and an inner surface. The structural mesh layer is positioned on the outer surface of the strike plate and includes lattice structure with a first structural compliance. The outer skin layer is positioned over the structural mesh layer. The compliant mesh layer is positioned on the inner surface and includes lattice structure with a second structural compliance that is greater than the first structural compliance. The inner skin layer is positioned over the compliant mesh layer.

20 Claims, 9 Drawing Sheets

MULTI-LAYER WEARABLE BODY ARMOR

STATEMENT REGARDING FEDERALLY-SPONSORED RESEARCH OR DEVELOPMENT

This invention was made with Government support under Contract No.: DE-NA-0002839 awarded by the United States Department of Energy/National Nuclear Security Administration. The Government has certain rights in the invention.

BACKGROUND

Backside deformation of body armor is a common source of injury and sometimes even death. Even though a panel of body armor may stop a projectile, the energy transferred to the wearer through a backside deformation can be a damaging amount. Current solutions for lessening this includes attaching trauma pads to the backside of body armor. However, trauma pads are often made of just open cell foam that does not absorb enough of the backside deformation energy.

The background discussion is intended to provide information related to the present invention which is not necessarily prior art.

SUMMARY OF THE INVENTION

The present invention solves the above-described problems and other problems by providing armor plates and methods of forming the same that better absorb energy that causes backside deformation.

A multi-layer armor plate constructed according to an embodiment of the present invention comprises a strike plate, a structural mesh layer, an outer skin, a compliant mesh layer, and an inner skin layer. The strike plate has an outer surface and an inner surface. The structural mesh layer is positioned on the outer surface of the strike plate and includes lattice structure with a first structural compliance. The outer skin layer is positioned over the structural mesh layer.

The compliant mesh layer is positioned on the inner surface and includes lattice structure with a second structural compliance that is greater than the first structural compliance. The inner skin layer is positioned over the compliant mesh layer. The structural mesh layer and the strike plate stop penetration of a projectile, while the compliant mesh layer absorbs backside deformation of the strike plate and/or the structural mesh layer, thereby preventing injury to the wearer.

A method of forming a multi-layer, wearable body armor plate according to an embodiment of the present invention broadly comprises depositing metal material via additive manufacturing to form a strike plate having an inner surface and an outer surface; depositing metal material via additive manufacturing to form a structural mesh layer on the outer surface of the strike plate, the structural mesh layer having lattice structure with a first structural compliance; depositing material via additive manufacturing to form an outer skin layer over the structural mesh layer; depositing material via additive manufacturing to form a compliant mesh layer on the inner surface of the strike plate, the structural mesh layer having lattice structure with a second structural compliance that is greater than the first structural compliance; and depositing material via additive manufacturing to form an inner skin layer over the compliant mesh layer.

A multi-layer armor plate constructed according to another embodiment of the present invention broadly comprises a strike plate, a structural mesh layer, an outer skin layer, a compliant mesh layer, and an inner skin layer. The strike plate is made of metal matrix composite and has an outer surface and an inner surface. The structural mesh layer is positioned on the outer surface of the strike plate and comprises lattice structure with unit cells having linear ligaments. The outer skin layer is positioned over the structural mesh layer. The compliant mesh layer is positioned on the inner surface and comprises lattice structure with unit cells having curved ligaments. The inner skin layer is positioned over the compliant mesh layer.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
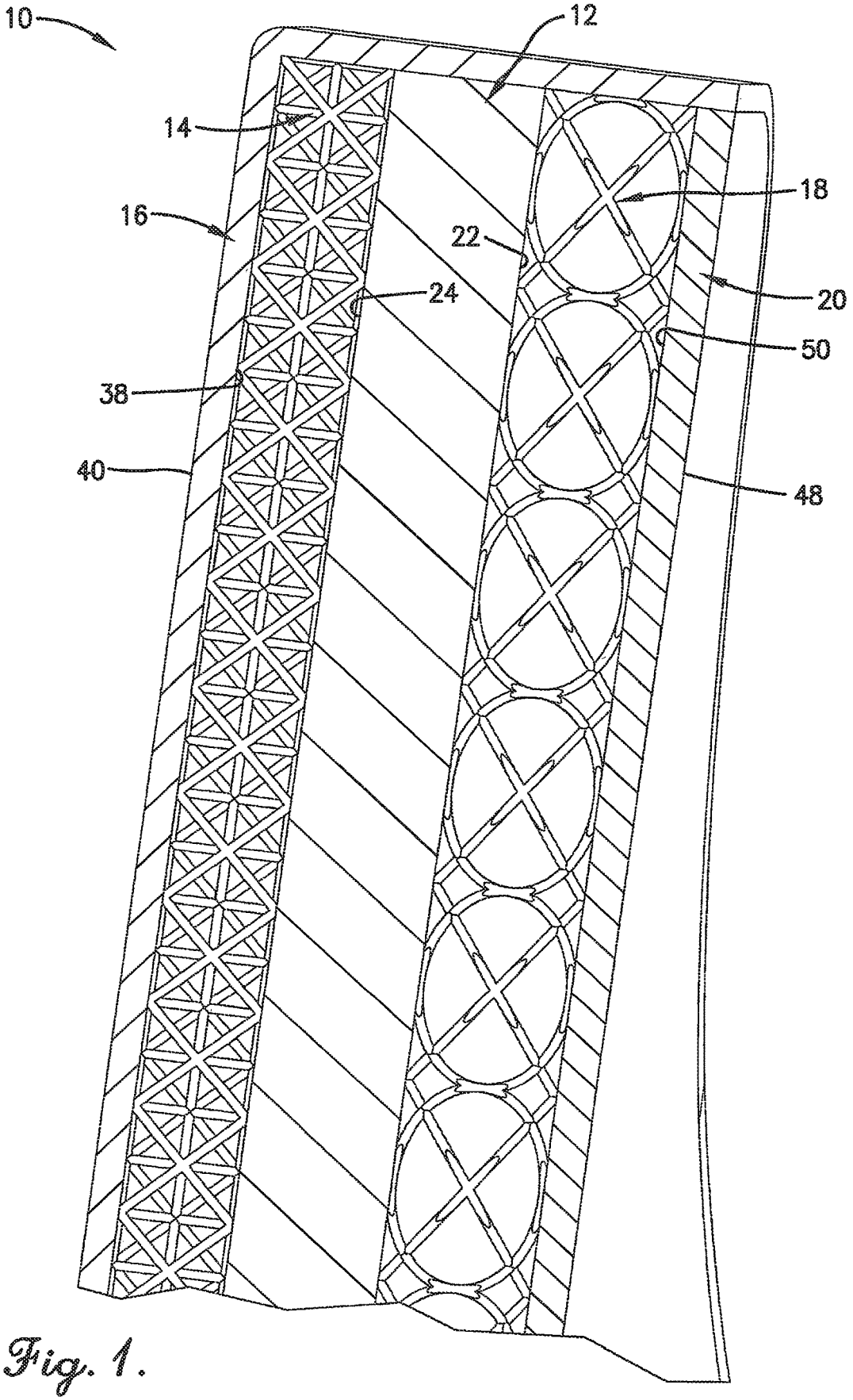
FIG. 1 is a partial vertical cross-sectional view of a body armor plate constructed in accordance with an embodiment of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Embodiments of the present invention provide a body armor plate formed of multiple layers that are cooperatively configured so as to be thinner and lighter than ceramic or steel body armor plates, more effective against projectile fragmentation, capable of withstanding multiple projectile hits, and less negatively buoyant and therefore safer to wear in or near bodies of water. Some or all of the layers of the body armor plate may be formed via additive manufacturing techniques so that the body armor plate may be more easily sized and shaped to conform to a particular wearer's physique. The plates are preferably formed of a metal matrix composite material that is stronger and lighter than many conventional materials.

Figure 2:
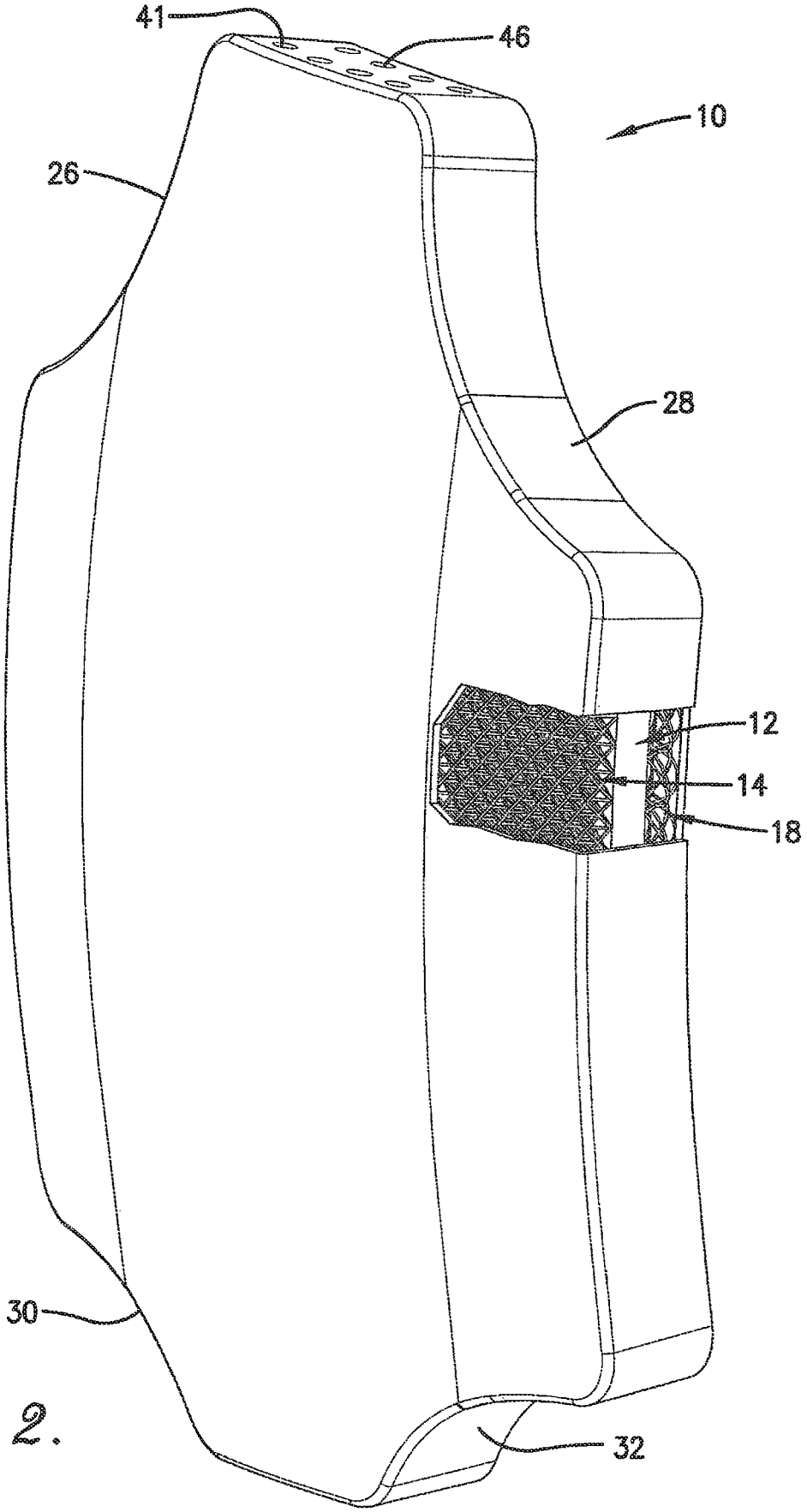
FIG. 2 is a front elevational view of the body armor plate of FIG. 1 with portions hidden to reveal interior features.

Specific embodiments of the body armor plate will now be described with reference to the attached drawing figures. Turning now to FIGS. 1 and 2, a body armor plate 10 constructed in accordance with embodiments of the invention is illustrated and broadly comprises a strike plate 12, a structural mesh layer 14, an outer skin layer 16, a compliant mesh layer 18, and an inner skin layer 20. Each of these layers are described in more detail below.

The strike plate 12 has an inner surface 22 that may be shaped to at least partially conform to the wearer's chest, back, or other body portion and an outer strike surface 24 that may be impacted by a ballistic projectile. As shown in FIG. 2, concave reliefs 26, 28 may be formed in the upper corners of the strike plate 12 for accommodating the wearer's arms. Similar concave reliefs 30, 32 may be formed in the lower corners of the strike plate 12 for accommodating the wearer's hips and thighs. In one embodiment, the strike plate 12 has a multi curved profile for conforming to the wearer's torso. Specifically, the strike plate 12 may be curved from top-to bottom and from side-to-side so as to closely conform to a wearer's chest and/or abdomen. The strike plate 12 may be formed in any thickness, and in one embodiment, is between 3.175 millimeters and 12.7 millimeters thick.

The strike plate 12 may be formed of a metal matrix composite material comprising a metal matrix and a nanocellulose supplement. The metal matrix forms a base structure and may be a monolithic material such that the metal matrix is continuous throughout the composite material. The metal matrix may be formed of aluminum, magnesium, titanium, or other structural metals, or cobalt, cobalt nickel alloys, steel and ferrous alloys, or other metals for high temperature applications. The metal matrix may be formed from a metal base material such as a powder or feedstock.

The nanocellulose supplement improves properties of the composite material and may be microscopic nanocellulose particles dispersed throughout the metal matrix. The nanocellulose supplement may be substantially mixed with particles of the metal matrix such that the composite material is a homogenous composite. The nanocellulose supplement may be any form of nano structured cellulose. This may be either cellulose nanofibers (CNF), also called microfibrillated cellulose (MFC), nanocrystalline cellulose (NCC), also called crystalline nanocellulose, and bacterial nanocellulose, which refers to nano structured cellulose produced by bacteria, among others, not to limit other potential forms or sources of nanocellulose. The nanocellulose supplement may increase the strength, change porosity of the metal matrix, or alter other properties of the composite material. The nanocellulose supplement may be formed from a nanocellulose supplement material.

Use of such a metal matrix composite material allows the strike plate 12 (and other layers of the body armor plate 10 if formed from the same materials) to be relatively thin and lightweight while still providing sufficient protection against projectiles. This material also resists cracking and thus provides all or much of its initial protection even when subjected to multiple ballistic strikes in the same area. The above-described metal matrix composite material may be used to form the strike plate and/or other layers of the body armor plate 10 via an additive manufacturing process described below.

Turning to FIGS. 4-8, the structural mesh layer 14 is positioned over the outer strike surface 24 of the strike plate 12 (depicted in FIG. 1) and comprises lattice structure made of a plurality of unit cells 34 positioned on the outer strike surface 24 of the strike plate 12. The unit cells 34 may comprises a plurality of linear ligaments 36 extending from the outer strike surface 24. While the depicted unit cells 34 are body centric, the unit cells 34 may be any shape without departing from the scope of the present invention. The structural mesh layer 14 may be less dense than the strike plate 12 and operable to absorb a significant amount of energy on initial contact from a projectile.

The structural mesh layer 14 may include the same concave reliefs and multi-curved profile as the strike plate 12 so as to match the overall shape and size of the strike plate. The structural mesh layer 14 may have any thickness without departing from the scope of the present invention.

The structural mesh layer may 14 be co-formed with the strike plate 12 via the same additive manufacturing process or may be formed separately and adhered to the strike plate 12 with adhesives or fasteners. Similarly, the structural mesh layer 14 may be formed of the same metal matrix composite material as the strike plate 12 or a different material.

Turning briefly back to FIG. 1, the outer skin layer 16 is formed over the structural mesh layer 14 and has an inner surface 38 and an opposite outer surface 40. The outer skin layer 16 may wrap around the edges of the mesh layer 14 so that its inner surface 38 encapsulates the lattice structure of the structural mesh layer 14 between it and the strike plate 12. The outer skin layer 16 may have any thickness without departing from the scope of the present invention.

The outer skin layer 16 may be co-formed with the strike plate 12 and/or the structural mesh layer 14 via the same additive manufacturing process or may be formed separately and adhered to the strike plate 12 and/or the structural mesh layer 14. Likewise, the outer skin layer 16 may be formed of the same metal matrix composite material as the strike plate 12 or a different material. As illustrated in FIG. 2, the outer skin layer 16 may also have access holes 41 along one or more of its edges through which excess powder may drain after an additive manufacturing process has been completed.

Turning to FIGS. 9-13, the compliant mesh layer 18 is positioned on the inner surface 22 of the strike plate 12 (depicted in FIG. 1) and comprises lattice structure made of a plurality of unit cells 42. The unit cells 42 may comprises a plurality of curved ligaments 44 extending from the inner surface 22. The shape, size, and density of the unit cells 42 cause the compliant mesh layer 18 more compliant than the structural mesh layer 14 in terms of deformation in meters per Newtons of force. The ligaments 44 of the compliant mesh layer 18 may have a smaller diameter than the diameter of the ligaments 36 of the structural mesh layer 14. Additionally, the unit cells 42 of the compliant mesh layer 18 may be smaller in terms of volume than the unit cells 34 of the structural mesh layer 14. In some embodiments, the number of ligaments 44 in each unit cell 42 of the compliant mesh layer 18 may be less than the number of ligaments 36 in each unit cell 34 of the structural mesh layer 14.

While the depicted unit cells 42 are body centric, the unit cells 42 may be any shape without departing from the scope of the present invention. The compliant mesh layer 18 may be less dense than the strike plate 12 and/or the structural mesh layer 14. The compliant mesh layer 18 is operable to absorb a significant amount of energy from backside deformation of the strike plate 12.

The compliant mesh layer 18 may include the same concave reliefs and multi-curved profile as the strike plate 12 so as to match the overall shape and size of the strike plate. The compliant mesh layer 18 may have any thickness without departing from the scope of the present invention.

The compliant mesh layer 18 may be co-formed with the strike plate 12 via the same additive manufacturing process or may be formed separately and adhered to the strike plate 12 with adhesives or fasteners. Similarly, the compliant mesh layer 18 may be formed of the same metal matrix composite material as the strike plate 12 or a different material.

Turning briefly back to FIG. 1, the inner skin layer 20 is formed over the compliant mesh layer 18 and has an inner face 48 and an opposite outer face 50. The inner skin layer 20 may wrap around the edges of the compliant mesh layer 18 so that its outer face 50 encapsulates the lattice structure of the compliant mesh layer 18 between it and the strike plate 12. The inner skin layer 20 may have any thickness without departing from the scope of the present invention.

The inner skin layer 20 may be co-formed with the strike plate 12 and/or the compliant mesh layer 18 via the same additive manufacturing process or may be formed separately and adhered to the strike plate 12 and/or the compliant mesh layer 18. Likewise, the inner skin layer 20 may be formed of the same metal matrix composite material as the strike plate 12 or a different material. As illustrated in FIG. 2, the inner skin layer 20 may also have access holes 46 along one or more of its edges through which excess powder may drain after an additive manufacturing process has been completed. The access holes 41, 46 may be sealed after completion of body armor plate 10 so that air can be trapped within the structural mesh layer 14 and the compliant mesh layer 18.

Embodiments of the invention may also include a vest or other wearable article of clothing for supporting one or more of the above-described body armor plates 10 over a wearer's torso or other body part. The body armor plates 10 may also be applied to or embedded within objects such as vehicle door panels, walls, ceilings, etc.

The above-described body armor plate 10 provides numerous advantages. For example, the layers 12, 14, 16, 18, 20 cooperate to arrest projectile fragments and reduce related injuries. When a projectile strikes the body armor plate 10, it penetrates, but is slowed by, the outer skin layer 16 and the structural mesh layer 14. When it strikes the strike plate 12, it may fragment, but the fragments are slowed by and trapped within the structural mesh layer 14. Further, if the projectile causes the strike plate 12 to deform backwards, the compliant mesh layer 18 is operable to deform to absorb the backside deformation of the strike plate 12 and/or the residual energy. This protects the wearer and those nearby from fragmentation. The trapped air inside the structural mesh layer 14 and/or the compliant mesh layer 18 also improve the negative buoyancy of the body armor plate 10.

Figure 3:
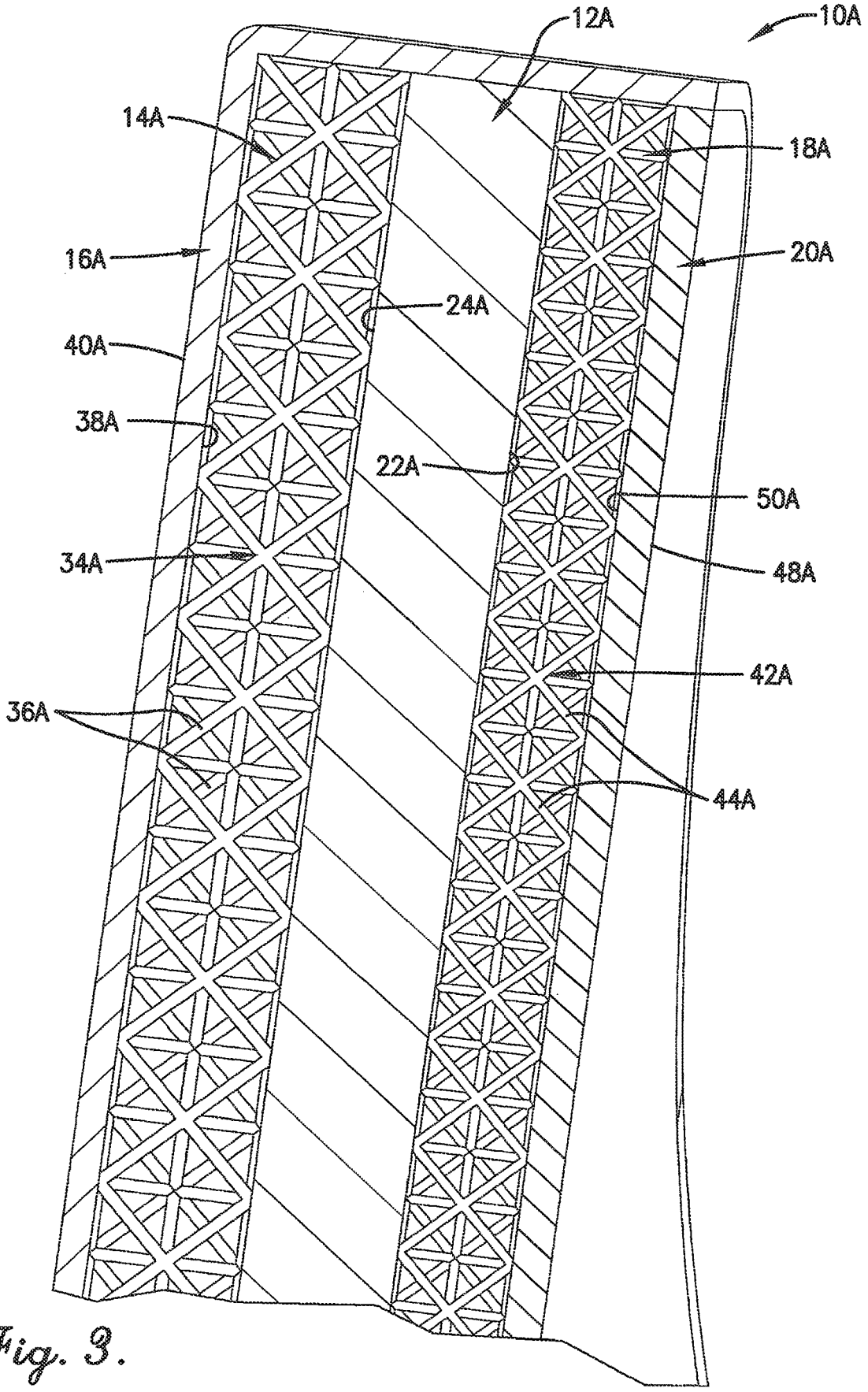
FIG. 3 is a partial vertical cross-sectional view of a body armor plate constructed in accordance with another embodiment of the present invention.
Figure 4:
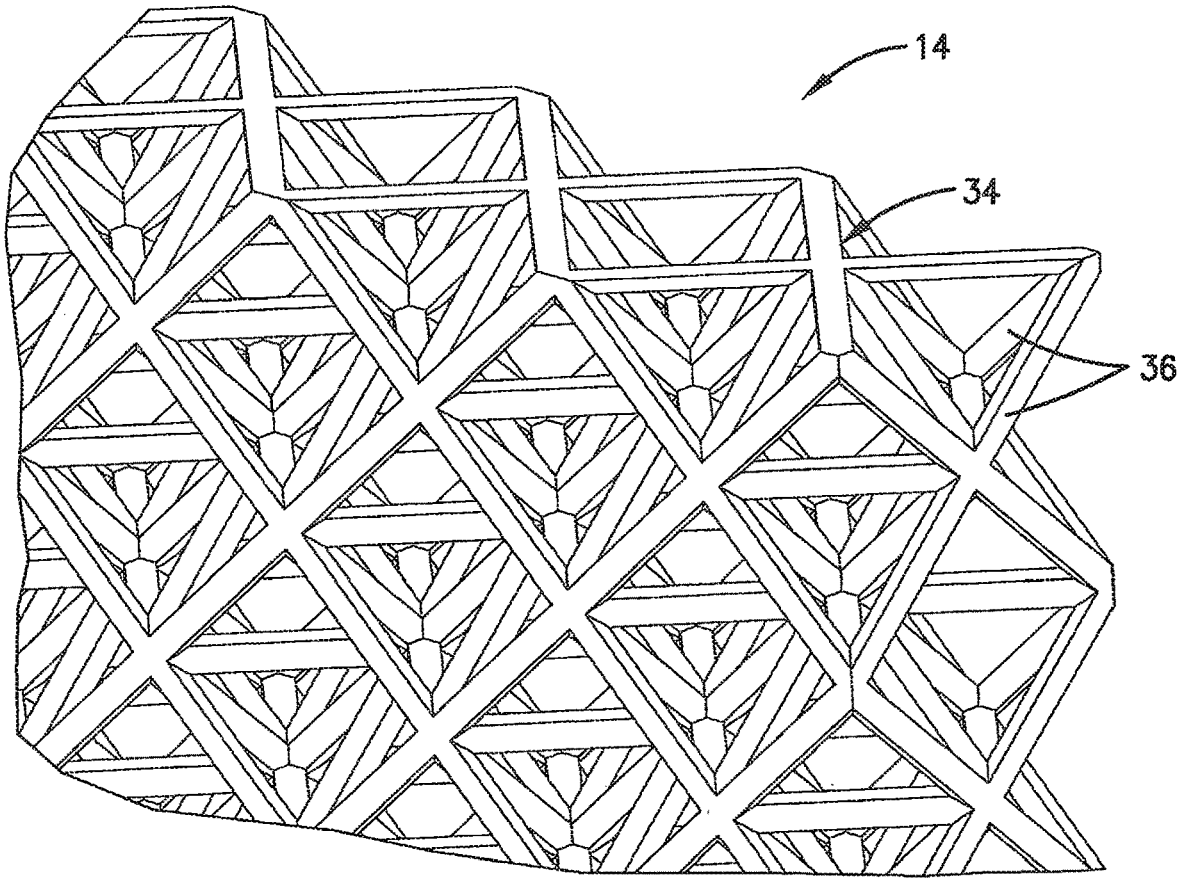
FIG. 4 is a partial view of a top right corner of a structural mesh layer of the body armor plate of FIG. 1.
Figure 5:
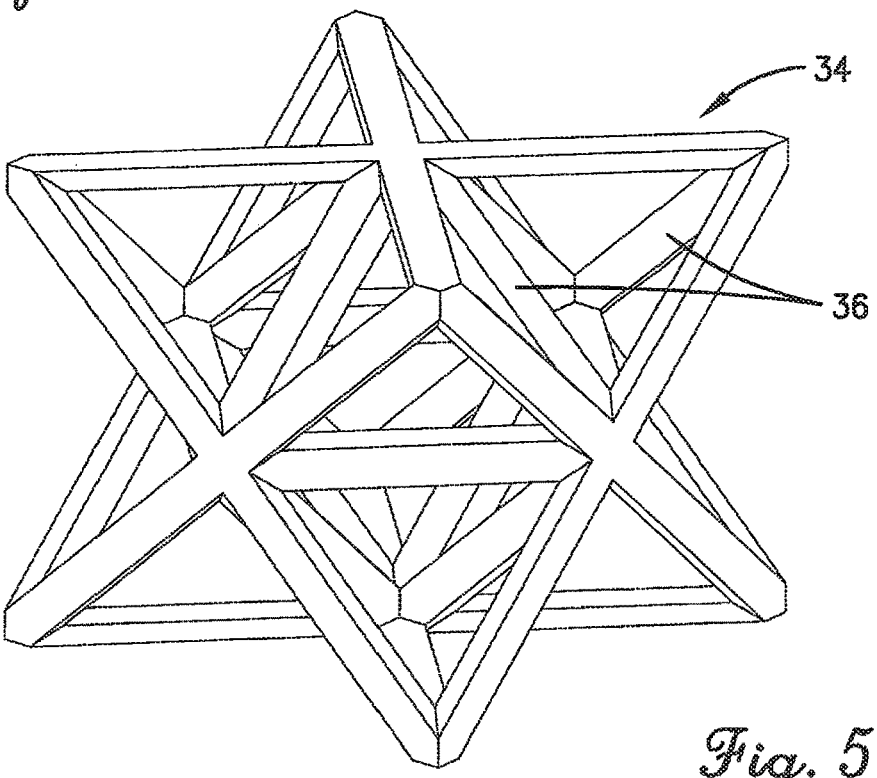
FIG. 5 is a view of an exemplary unit cell of the structural mesh layer of FIG. 4.
Figure 6:
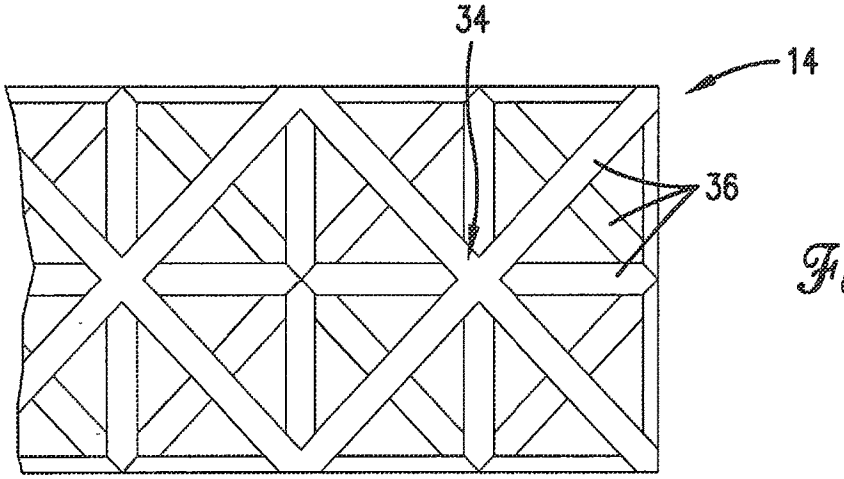
FIG. 6 is a top plan view of the top right corner of the structural mesh layer of FIG. 4.
Figure 7:
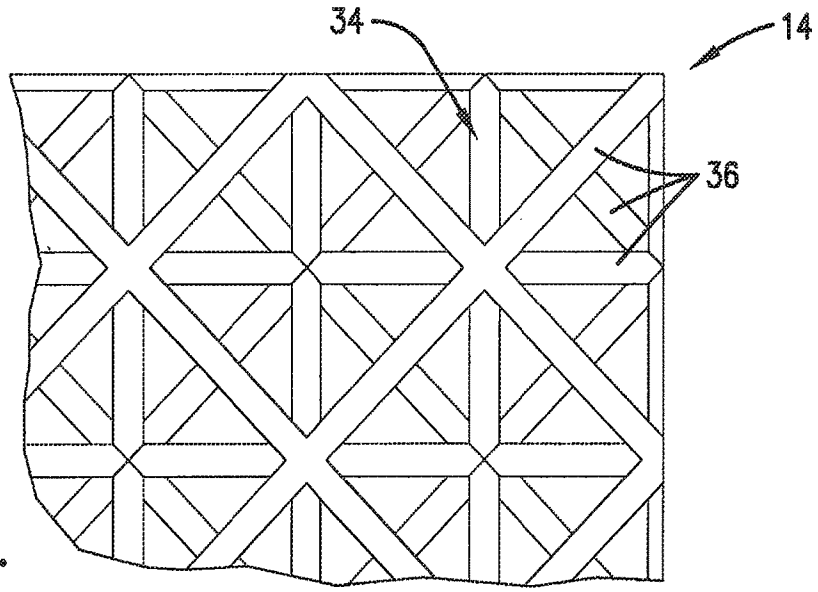
FIG. 7 is a front plan view of the top right corner of the structural mesh layer of FIG. 4.
Figure 8:
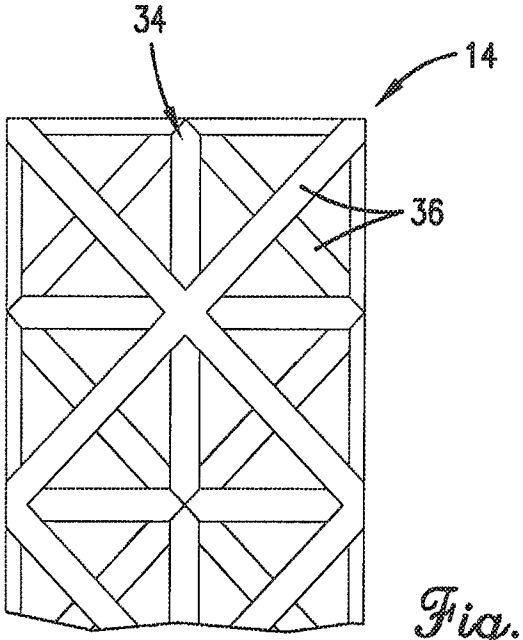
FIG. 8 is a side elevational view of the top right corner of the structural mesh layer of FIG. 4.
Figure 9:
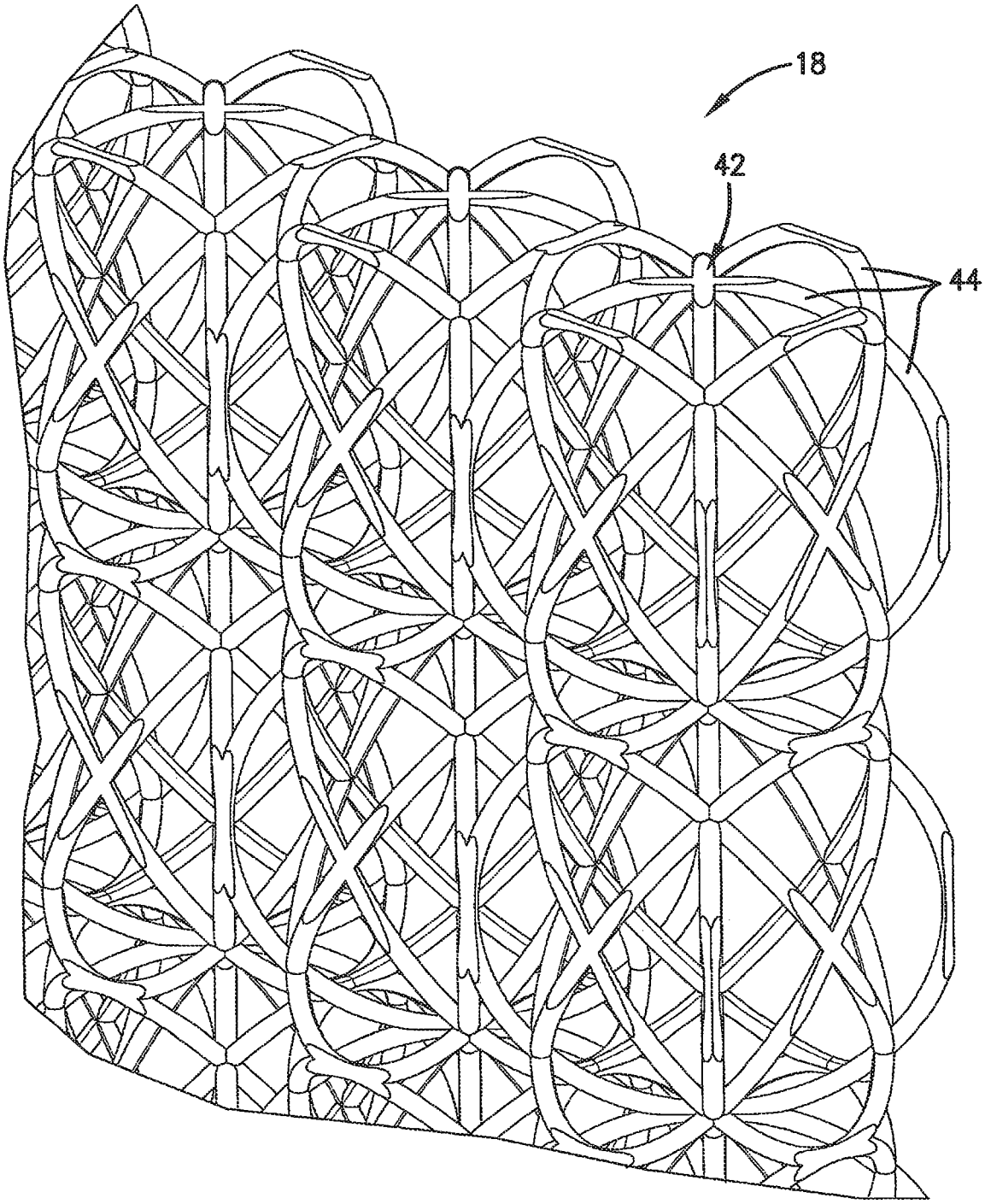
FIG. 9 is a partial view of a top right corner of a compliant mesh layer of the body armor plate of FIG. 1.
Figure 10:
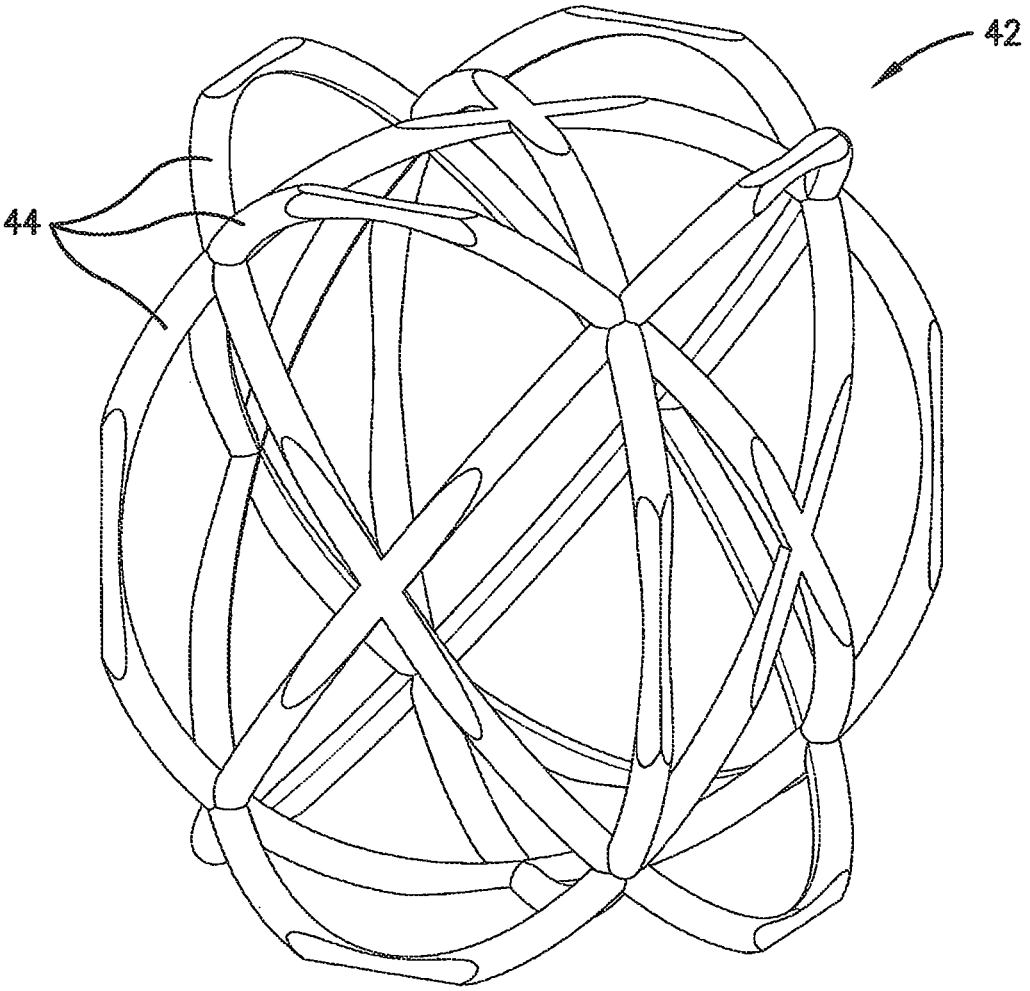
FIG. 10 is a view of an exemplary unit cell of the compliant mesh layer of FIG. 9.
Figure 11:
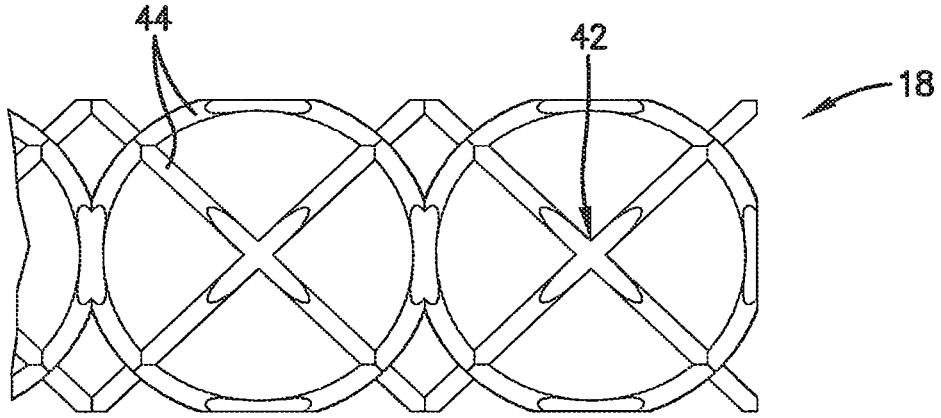
FIG. 11 is a top plan view of the top right corner of the compliant mesh layer of FIG. 9.
Figure 13:
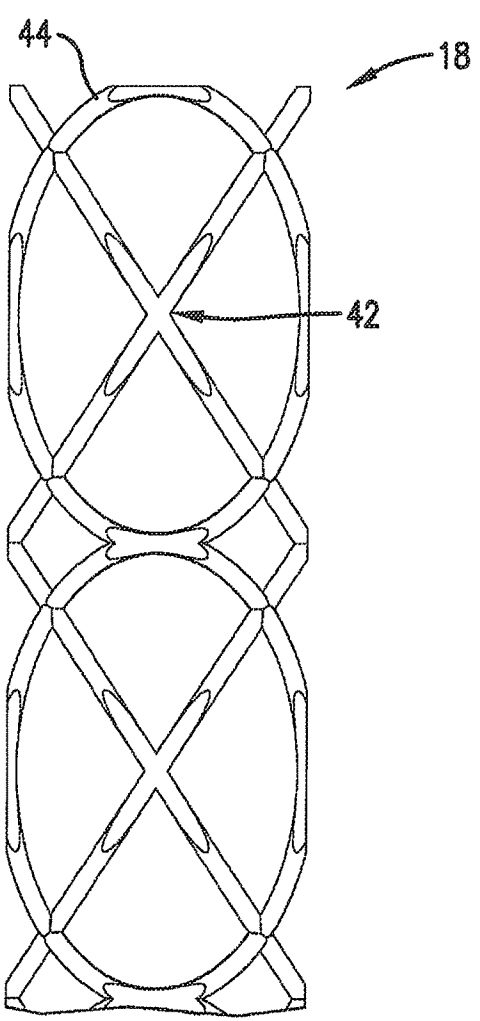
FIG. 13 is a side elevational view of the top right corner of the compliant mesh layer of FIG. 9.
Figure 12:
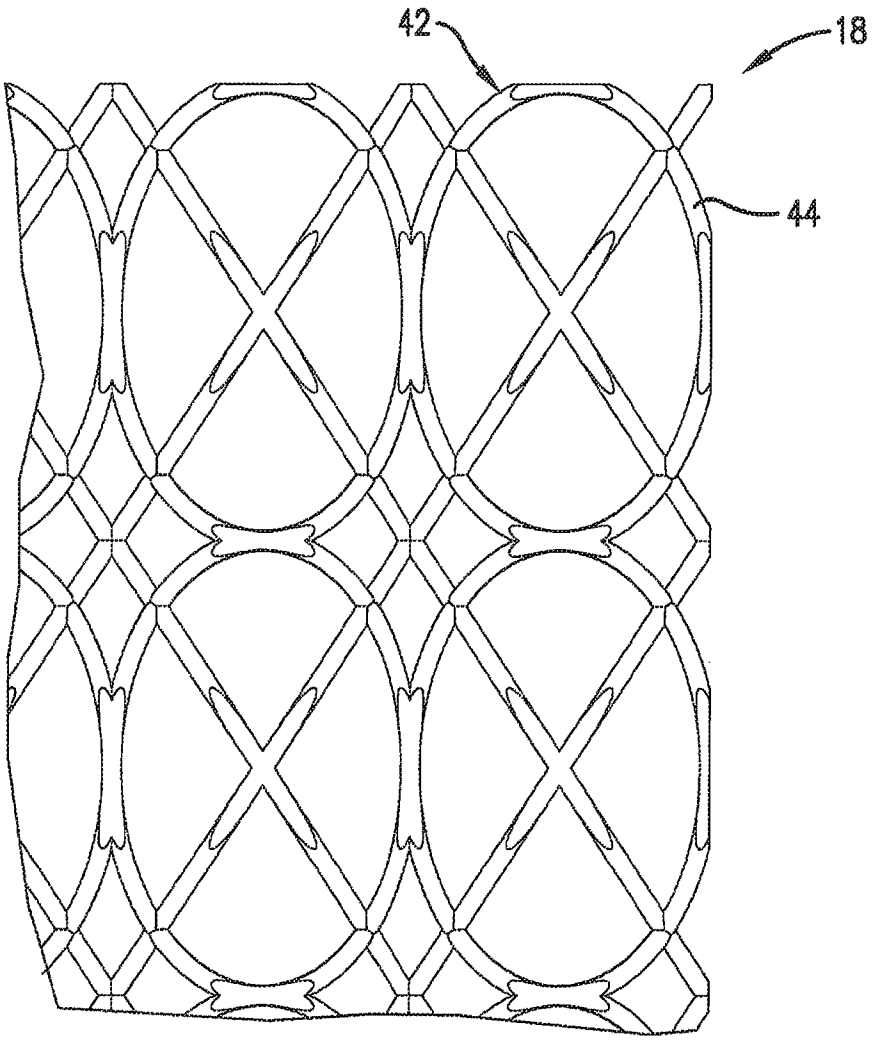
FIG. 12 is a front plan view of the top right corner of the compliant mesh layer of FIG. 9.

A body armor plate 10A constructed in accordance with another embodiment of the invention is shown in FIG. 3. The body armor plate 10A may comprise substantially similar components as body armor plate 10; thus, the components of body armor plate 10A that correspond to similar components in body armor plate 10 have an 'A' appended to their reference numerals. The principal difference between body armor plate 10A and body armor plate 10 is that the compliant mesh layer 18A is formed with unit cells 42A that have linear ligaments 44A; however, the linear ligaments 44A of the compliant mesh layer 18A are smaller in diameter than the ligaments 36A of the unit cells 34A forming the structural mesh layer 14A.

Figure 14:
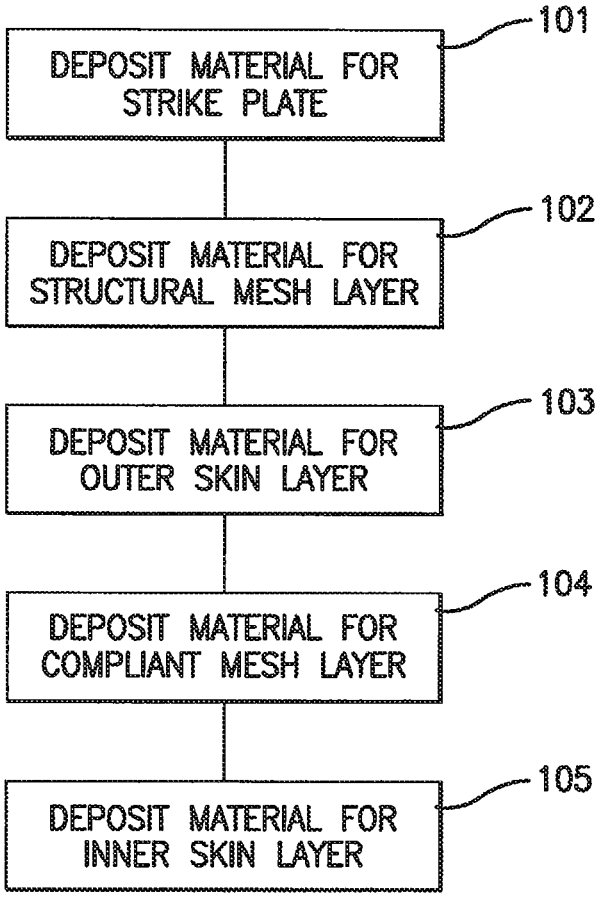
FIG. 14 is a flow diagram depicting steps in a method of fabricating the body armor plate via an additive manufacturing process according to another embodiment of the present invention.

The flow chart of FIG. 14 depicts the steps of an exemplary method 100 of forming a multi-layer, wearable armor plate. In some alternative implementations, the functions noted in the various blocks may occur out of the order depicted in FIG. 14. For example, two blocks shown in succession in FIG. 14 may in fact be executed substantially concurrently, or the blocks may sometimes be executed in the reverse order depending upon the functionality involved. In addition, some steps may be optional. In one embodiment, the body armor plate is fabricated with powder bed fusion additive manufacturing techniques comprising the following steps.

Referring to step 101, the strike plate is formed by depositing a metal matrix composite material onto a form or other structure. The strike plate may be formed so as to have a multi curved profile, an inner surface, an outer strike surface, upper corner concave reliefs, and lower corner concave reliefs. This step may comprise or be proceeded by the step of designing the shape and multi curved profile of the strike plate so it conforms to a particular wearer's torso or other body part.

Referring to step 102, the structural mesh layer is formed by depositing additional metal matrix composite material on the strike plate. Alternatively, the structural mesh layer may be formed separately from the strike plate and subsequently glued or otherwise attached to the strike plate. The structural mesh layer may be formed so as to have an inner side positioned on the outer strike surface of the strike plate and an opposite outer side. The structural mesh layer comprises a plurality of unit cells that form a lattice structure. The unit cells of the structural mesh layer may comprise body centric cells with linear ligaments.

Referring to step 103, the outer skin layer is formed by depositing additional metal matrix composite material on the structural mesh layer. Alternatively, the outer skin layer may be formed separately and glued on or otherwise attached over the structural mesh layer. The outer skin layer is preferably formed so as to extend over the edges of the structural mesh layer to encapsulate the structural mesh layer between the strike plate and the outer skin layer. The access holes in the outer skin layer may also be formed in this step.

Referring to step 104, the compliant mesh layer is formed by depositing additional metal matrix composite material on the strike plate. Alternatively, the compliant mesh layer may be formed separately from the strike plate and subsequently glued or otherwise attached to the strike plate. The compliant mesh layer may be formed so as to have an inner side positioned on the inner surface of the strike plate and an opposite inner side. The compliant mesh layer comprises a plurality of unit cells that form a lattice structure. The unit cells of the compliant mesh layer may comprise body centric cells with curved ligaments, linear ligaments, narrower ligaments, or other types of ligaments that otherwise cause the compliant mesh layer to be more compliant than the structural mesh layer.

Referring to step 105, the inner skin layer is formed by depositing additional metal matrix composite material on the compliant mesh layer. Alternatively, the inner skin layer may be formed separately and glued on or otherwise attached over the compliant mesh layer. The inner skin layer is preferably formed so as to extend over the edges of the compliant mesh layer to encapsulate the compliant mesh layer between the strike plate and the inner skin layer. The access holes in the inner skin layer may also be formed in this step.

Forming some or all of the layers of the body armor plate via additive manufacturing as described above permits the body armor plates to be sized and shaped to conform to a particular wearer's physique. Moreover, additive manufacturing permits the thicknesses of the strike plate and other layers to be selected to provide protection against different types and speeds of ballistic projectiles. Different portions of each layer can also be formed in different thickness to provide extra protection or extra mobility as needed. For example, portions of the layers configured to cover a wearer's heart may be relatively thicker for added protection whereas portions of the layers configured to cover a wearer's hips may be relatively thinner to provide better mobility.

The method 100 may include additional, less, or alternate steps and/or device(s), including those discussed elsewhere herein. For example, during the formation of the layers, any unfused metal matrix powder may be drained from the body armor plate via the access holes. The access holes may also be sealed with any suitable materials.

ADDITIONAL CONSIDERATIONS

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the current technology can include a variety of combinations and/or integrations of the embodiments described herein.

Although the present application sets forth a detailed description of numerous different embodiments, it should be understood that the legal scope of the description is defined by the words of the claims set forth in any subsequent regular utility patent application. The detailed description is to be construed as exemplary only and does not describe every possible embodiment since describing every possible embodiment would be impractical. Numerous alternative embodiments may be implemented, using either current technology or technology developed after the filing date of this patent, which would still fall within the scope of the claims.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

The patent claims at the end of this patent application are not intended to be construed under 35 U.S.C. § 112(f) unless traditional means-plus-function language is expressly recited, such as "means for" or "step for" language being explicitly recited in the claim (s).

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

The invention claimed is:

1. A multi-layer armor plate comprising:

a strike plate having an outer surface and an inner surface;

a structural mesh layer positioned on the outer surface of the strike plate and comprising lattice structure with a first structural compliance;

an outer skin layer positioned over the structural mesh layer;

a compliant mesh layer positioned on the inner surface and comprising lattice structure with a second structural compliance that is greater than the first structural compliance; and an inner skin layer positioned over the compliant mesh layer.

2. The armor plate of claim 1, wherein the lattice structure of the compliant mesh layer comprises unit cells with curved ligaments.

3. The armor plate of claim 2, wherein the lattice structure of the compliant mesh layer comprises unit cells with linear ligaments.

4. The armor plate of claim 2, wherein the lattice structure of the structural mesh layer comprises unit cells with linear ligaments.

5. The armor plate of claim 1, wherein the lattice structure of the compliant mesh layer comprises unit cells with a first volume, and the lattice structure of the structural mesh layer comprises unit cells with a second volume that is greater than the first volume.

6. The armor plate of claim 1, wherein the strike plate is denser than the structural mesh layer and the compliant mesh layer.

7. The armor plate of claim 1, wherein the lattice structure of the compliant mesh layer comprises unit cells with ligaments having first diameters, and the lattice structure of the structural mesh layer comprises unit cells with ligaments having second diameters that are greater than the first diameters.

8. The armor plate of claim 1, wherein the lattice structure of the compliant mesh layer comprises unit cells with a first number of ligaments, and the lattice structure of the structural mesh layer comprises unit cells with a second number of ligaments that is greater than the first number.

9. The armor plate of claim 1, wherein the strike plate is made of metal matrix composite.

10. The armor plate of claim 1, wherein the lattice structure of the structural mesh layer comprises body centric unit cells.

11. A method of forming a multi-layer, wearable body armor plate comprising:

depositing metal material via additive manufacturing to form a strike plate having an inner surface and an outer surface;

depositing metal material via additive manufacturing to form a structural mesh layer on the outer surface of the strike plate, the structural mesh layer having lattice structure with a first structural compliance;

depositing material via additive manufacturing to form an outer skin layer over the structural mesh layer;

depositing material via additive manufacturing to form a compliant mesh layer on the inner surface of the strike plate, the structural mesh layer having lattice structure with a second structural compliance that is greater than the first structural compliance; and depositing material via additive manufacturing to form an inner skin layer over the compliant mesh layer.

12. The method of claim 11, wherein the lattice structure of the compliant mesh layer is formed to have unit cells with curved ligaments.

13. The method of claim 12, wherein the lattice structure of the structural mesh layer is formed to have unit cells with linear ligaments.

14. The method of claim 11, wherein the material forming the compliant mesh layer comprises metal.

15. A multi-layer armor plate comprising:

a strike plate made of metal matrix composite and having an outer surface and an inner surface;

a structural mesh layer positioned on the outer surface of the strike plate and comprising lattice structure with unit cells having linear ligaments;

an outer skin layer positioned over the structural mesh layer;

a compliant mesh layer positioned on the inner surface and comprising lattice structure with unit cells having curved ligaments; and an inner skin layer positioned over the compliant mesh layer.

16. The armor plate of claim 15, wherein the curved ligaments have diameters less than diameters of the linear ligaments.

17. The armor plate of claim 15, wherein the units cells of the compliant mesh layer have fewer ligaments than the unit cells of the structural mesh layer.

18. The armor plate of claim 15, wherein the unit cells of the structural mesh layer are larger than the unit cells of the compliant mesh layer.

19. The armor plate of claim 15, wherein the unit cells of the compliant mesh layer comprise linear ligaments.

20. The armor plate of claim 15, wherein the strike plate is denser than the structural mesh layer and the compliant mesh layer.

* * * * *